US008451204B2

(12) United States Patent
Shimoshikiryoh

(10) Patent No.: US 8,451,204 B2
(45) **Date of Patent: *May 28, 2013**

(54) LIQUID CRYSTAL DISPLAY DEVICE

(75) Inventor: Fumikazu Shimoshikiryoh, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/137,626

(22) Filed: Aug. 30, 2011

(65) Prior Publication Data

US 2011/0316894 A1 Dec. 29, 2011

Related U.S. Application Data

(63) Continuation of application No. 11/187,953, filed on Jul. 25, 2005, now Pat. No. 8,022,912.

(30) Foreign Application Priority Data

Jul. 26, 2004 (JP) ..... 2004-217589

(51) Int. Cl.
*G09G 3/36* (2006.01)

(52) U.S. Cl.
USPC ..... 345/92; 345/87; 345/96; 345/98

(58) Field of Classification Search
USPC ..... 345/87–104, 204–215, 690–696
See application file for complete search history.

(56) References Cited

U.S. PATENT DOCUMENTS

| | | | | |
|---|---|---|---|---|
| 5,841,410 | A | 11/1998 | Oda et al. | |
| 5,905,482 | A | 5/1999 | Hughes et al. | |
| 6,028,598 | A | 2/2000 | Suyama et al. | |
| 7,193,601 | B2 | 3/2007 | Furuya | |
| 8,022,912 | B2 * | 9/2011 | Shimoshikiryoh | 345/92 |
| 2001/0043187 | A1 | 11/2001 | Ikeda | |
| 2002/0080131 | A1 | 6/2002 | Fujino | |
| 2002/0171779 | A1 | 11/2002 | Kimura et al. | |
| 2003/0169247 | A1 | 9/2003 | Kawabe et al. | |
| 2003/0227429 | A1 | 12/2003 | Shimoshikiryo | |
| 2004/0001167 | A1 | 1/2004 | Takeuchi et al. | |
| 2004/0119704 | A1 | 6/2004 | Miyajima et al. | |

FOREIGN PATENT DOCUMENTS

| | | |
|---|---|---|
| JP | 9-81092 | 3/1997 |
| JP | 2983787 | 9/1999 |
| JP | 2003-5721 | 1/2003 |
| JP | 2004-62146 | 2/2004 |
| JP | 2004-78157 | 3/2004 |

OTHER PUBLICATIONS

U.S. Office Action dated Dec. 2, 2008 corresponding to U.S. Appl. No. 11/187,953.
U.S. Office Action dated Jul. 13, 2009 corresponding to U.S. Appl. No. 11/187,953.
U.S. Office Action dated Feb. 2, 2010 corresponding to U.S. Appl. No. 11/187,953.
U.S. Office Action dated Sep. 2, 2010 corresponding to U.S. Appl. No. 11/187,953.
U.S. Notice of Allowance dated May 19, 2011 corresponding to U.S. Appl. No. 11/187,953.
U.S. Advisory Action dated Jan. 24, 2011 corresponding to U.S. Appl. No. 11/187,953.
U.S. Notice of Allowance dated Mar. 12, 2013 corresponding to U.S. Appl. No. 13/064,139.

* cited by examiner

*Primary Examiner* — Vijay Shankar
(74) *Attorney, Agent, or Firm* — Harness, Dickey & Pierce, P.L.C.

(57) ABSTRACT

In a liquid crystal display device performing multi-picture element driving, gate OFF timing of a switching element connected between each sub picture element and a signal line is matched with phase timing when all the subsidiary capacity wires are at the same potential. This prevents the occurrence of uneven luminance appearing in a lateral streak.

22 Claims, 8 Drawing Sheets

(a)
Vs
COMMON
Ground (b)
Vcsa
Vad
COMMON
Ground
T3
T4
T5

(c)
Vcsb
Vad
COMMON
Ground
T1
T2

(d)
Vg
VgH
VgL
COMMON
Ground (e)
Vlca
Vd
COMMON
Ground (f)
Vlcb
Vd
COMMON
Ground

LIQUID CRYSTAL DISPLAY DEVICE

This non-provisional application is a continuation of and claims priority under 35 U.S.C. §120 on application Ser. No. 11/187,953 filed Jul. 25, 2005, now U.S. Pat. No. 8,022,912 which claims priority under 35 USC §119(a) on Japanese Patent Application No. 2004-217589 filed in Japan on Jul. 26, 2004, the contents of each of which are hereby incorporated by reference in their entirety for all purposes.

FIELD OF THE INVENTION

The present invention relates to a liquid crystal display device, particularly to a liquid crystal display device in a multi-picture element driving method that can improve viewing angle dependency of γ characteristics of a liquid crystal display device.

BACKGROUND OF THE INVENTION

A liquid crystal display device is a flat display device having excellent characteristics such as high definition, thin form, light weight and low consumption of electricity, and recently the market size of it is rapidly expanding due to the increase in display ability, the increase in producing ability, and the increase in competitive power of the price against other display devices.

For a liquid crystal display device in twisted nematic mode (TN mode) that has been general so far, an orientation process is carried out, in which a long axis of a liquid crystal molecule with positive permittivity anisotropy is oriented substantially in parallel to the surface of substrates, and the long axis of a crystal liquid molecule is twisted approximately 90° between the above and below substrates in a thickness direction of a liquid crystal layer. Applying a voltage on this liquid crystal layer allows the liquid crystal molecule to stand in parallel to an electric field and twisted orientation is eliminated. The liquid crystal display device in TN mode uses the change of optical rotation accompanying the change of orientation of the liquid crystal molecule due to a voltage, so as to control transmitted light volume.

The liquid crystal display device in TN mode has wide production margin and excellent productivity, but on the other hand has a problem in display ability, particularly in viewing angle characteristics. To put it concretely, there was a problem that when the display face of the liquid crystal display device in TN mode is observed from the side, the contrast ratio of display greatly lowers, and when the image in which a plurality of gradations from black to white are clearly observed from the front is observed from the side, the difference in luminance between gradations becomes very unclear. Further, a phenomenon in which gradation characteristics of display are inverted and the darker part in front view observation is seen brighter in side view observation (so-called gradation inversion phenomenon) is also problematic.

Recently, as liquid crystal display devices that improve viewing angle characteristics in the liquid crystal display devices in TN mode, such modes have been developed as in-plane switching mode (IPS mode), multi-domain vertical aligned mode (MVA mode) and axially symmetric aligned micro-cell mode (ASM mode).

Each of the liquid crystal devices in these new modes (wide viewing angle mode) solves the above concrete problems as to viewing angle characteristics. Namely, the problem that the contrast ratio of display greatly decreases or display gradation inverses when the display face is observed from the side is never generated.

However, under the condition where the improvement in display quality of a liquid crystal display device advances, as a problem of viewing angle characteristics, a new problem that γ characteristics in front view observation and γ characteristics in side view observation are different, namely, a new problem of viewing angle dependency of γ characteristics has appeared. Here, γ characteristics are gradation dependency of display luminance, and a difference in γ characteristics between when viewed from the front and when viewed from the side means that the state of gradation display is different according to the direction of observation, and therefore it is particularly problematic in displaying images such as photographs and in displaying TV broadcasting.

The problem of viewing angle dependency of γ characteristics is more prominent in MVA mode or ASM mode than in IPS mode. On the other hand, IPS mode has a difficulty in producing with good productivity panels with a high contrast ratio in front view observation, compared with MVA mode or ASM mode. In terms of these points, it is desirable to improve viewing angle dependency of γ characteristics in the liquid crystal display device particularly in MVA mode or ASM mode.

The inventor of the present application proposes a multi-picture element driving method as a method for improving the above viewing angle dependency of γ characteristics, in Japanese Laid-Open Patent Application No. 2004/62146 (Tokukai 2004-62146) (published date; Feb. 26, 2004, corresponding US application; US2003/0227429A1). First, this multi-picture element driving method is explained with reference to FIGS. 5 through 7.

The multi-picture element driving is a technology for composing one display picture element by using two or more sub picture elements having different luminance levels, so as to improve viewing angle characteristics (viewing angle dependency of γ characteristics). First, the principle of this technology is briefly explained.

FIG. 5 illustrates γ characteristics of a liquid crystal display panel (gradation (voltage)-luminance ratio). The full line in FIG. 5 shows γ characteristics in front view observation in a general driving method (in which one display picture element is not composed of a plurality of sub picture elements), and in this case, the most normal visibility can be gained. Further, the broken line in FIG. 5 shows γ characteristics in side view observation (viewing from the side) in a general driving method, and in this case, a shift occurs to normal vision (namely, vision in front view observation) and the amount of a shift is small in a place showing high luminance and low luminance, and large in a place showing halftones.

In the case of obtaining targeted luminance in one display picture element, the multi-picture element driving method performs display control so that in a plurality of sub picture elements having different luminance levels, the average luminance among them becomes targeted luminance. And in the multi-picture element driving method, γ characteristics in front view observation is set so as to obtain the most normal visibility, as with the case of the general driving method (the same characteristics as γ characteristics of a full line in FIG. 5). On the other hand, as for visibility from the side in the multi-picture element driving method, for example, in order to obtain targeted luminance in a halftone where uneven luminance usually increases, the multi-picture element driving method causes the sub picture elements to have the regions around high luminance and low luminance where uneven luminance decreases, so that the picture element as a whole can obtain the targeted luminance in a halftone by balancing luminance levels of those sub picture elements.

This decreases uneven luminance, and γ characteristics shown by a chain line in FIG. 5 can be obtained.

Next, one example of a structure of a liquid crystal display device for performing multi-picture element driving is illustrated in FIG. 6. As illustrated in FIG. 6, a picture element 10 corresponding to one display picture element is composed of sub picture elements 10*a* and 10*b* respectively including sub picture element electrodes 18*a* and 18*b*, and TFTs (Thin Film Transistor) 16*a* and 16*b*, and subsidiary capacities (CS) 22*a* and 22*b* are respectively connected to the sub picture elements 10*a* and 10*b*. Note that FIG. 6 illustrates one example of the structure of a picture element when one picture element is composed of two sub picture elements, to put it concretely, the structure in which the areas of the sub picture elements are substantially the same as each other and the sub picture elements are placed in a longitudinal direction, but the effect of the present invention is not limited to the arrangement illustrated in FIG. 6. As for the areas of each sub picture element, they may be different from each other as well as substantially the same as each other illustrated in FIG. 6. Concretely, it is possible to make the area of a sub picture element with high luminance in a halftone display condition smaller than the area of a sub picture element with low luminance, or on the contrary to make the area of a sub picture element with high luminance larger than the area of a sub picture element with low luminance. In terms of the improvement in viewing angle characteristics, the former is preferable. Further, as for the disposition of sub picture elements, instead of disposing above and below the sub picture elements with different luminance levels in displaying halftones, it may be that the lateral direction of the row of picture elements is made a standard axis, and the sub picture elements are disposed along the axis. In this case, the distribution of display polarity of the sub picture elements becomes like dot inversion, and therefore it is preferable in terms of display quality. FIGS. 10(*a*) and (*b*) illustrate examples of disposition of sub picture elements placed over a plurality of picture elements. ○ in FIGS. 10 (*a*) and (*b*) show sub picture elements with high display luminance, and + and − in ○ show electric polarity of picture elements (when the potential of a picture element electrode (sub picture element electrode) is high relative to the potential of a counter electrode, it is +, and when low, it is −).

FIG. 10(*a*) illustrates a case according to the disposition in FIG. 6, and FIG. 10(*b*) illustrates a case according to the above preferable disposition. In FIG. 10(*a*), the sub picture elements with high luminance in a halftone display condition are disposed in a checkered pattern (the weighted center of luminance of a picture element does not correspond to that of luminance of a sub picture element with high luminance, but they are disposed in a condition of high dispersibility on a screen), and noting either + or − of display polarity out of sub picture elements with high luminance shows that they are disposed in a line in the direction of a row. Namely, the disposition of the sub picture elements with high luminance is like line inversion. On the other hand, in FIG. 10(*b*), a sub picture element with high luminance is disposed in the center of a picture element (the weighted center of luminance of a picture element corresponds to that of luminance of a sub picture element with high luminance), and the display polarity of a sub picture element with high luminance shows the form of dot inversion as with the display polarity of a picture element. According to these conditions, FIG. 10(*b*) is preferable to FIG. 10(*a*) in terms of the disposition of a sub picture element.

Further, the shape of a sub picture element is not limited to a rectangle. Particularly, in the case of MVA mode, the shape may be a structure of dividing along rib or slit, namely, a structure such as a triangle or a rhomboid, and such a shape is preferable in terms of an open area ratio of a panel (see FIG. 10(*c*)).

Gate electrodes of the TFTs 16*a* and 16*b* are connected to a common (same) scan line 12, and a source electrode is connected to a common (same) signal line 14. The subsidiary capacities 22*a* and 22*b* are respectively connected to subsidiary capacity wires (CS bus lines) 24*a* and 24*b*.

The subsidiary capacities 22*a* and 22*b* are respectively composed of subsidiary capacity electrodes electrically connected to the sub picture element electrodes 18*a* and 18*b*, subsidiary capacity counter electrodes electrically connected to the subsidiary capacity wires 24*a* and 24*b*, and insulating layers (not shown in figures) disposed between these electrodes. The subsidiary capacity counter electrodes of the subsidiary capacities 22*a* and 22*b* are independent of each other, and have a structure for being supplied with subsidiary capacity counter voltages from the subsidiary capacity wires 24*a* and 24*b*, the subsidiary capacity counter voltages being different from each other.

Further, the driving signals of the liquid crystal display device illustrated in FIG. 6 are illustrated in FIGS. 7(*a*) through 7(*f*). FIG. 7(*a*) shows voltage waveform Vs of the signal line 14, FIG. 7(*b*) shows voltage waveform Vcsa of the subsidiary capacity wire 24*a*, FIG. 7(*c*) shows voltage waveform Vcsb of the subsidiary capacity wire 24*b*, FIG. 7(*d*) shows voltage waveform Vg of the scan line 12, FIG. 7(*e*) shows voltage waveform Vlca of the sub picture element electrode 18*a*, and FIG. 7(*f*) shows voltage waveform Vlcb of the sub picture element electrode 18*b*. Further, broken lines in FIGS. 7(*a*) through 7(*f*) show voltage waveform COMMON (Vcom) of a counter electrode (not shown in FIG. 6).

First, in time T1, the voltage Vg changing from VgL to VgH allows the TFT16*a* and the TFT16*b* to be conduction states (ON-states) simultaneously, and thereby the voltage Vs of the signal line 14 is transmitted to the sub picture element electrodes 18*a* and 18*b*, with a result that the sub picture elements 10*a* and 10*b* are charged. In the same way, the subsidiary capacities 22*a* and 22*b* of the respective sub picture elements are charged by the signal line 14.

Next, in time T2, the voltage Vg of the scan line 12 changing from VgH to VgL allows the TFT16*a* and the TFT16*b* to be non-conduction states (OFF-states) simultaneously, and thereby the charge of the sub picture elements 10*a* and 10*b* and the subsidiary capacities 22*a* and 22*b* is finished, with a result that the sub picture elements 10*a* and 10*b* and the subsidiary capacities 22*a* and 22*b* are electrically insulated from the signal line 14. Note that immediately after that, due to drawing phenomenon caused by the effect of parasitic capacitance or the like included by the TFT16*a* and the TFT16*b*, the voltage Vlca of the sub picture element electrode 18*a* and the voltage Vlcb of the sub picture element electrode 18*b* decrease by substantially the same voltage Vd, and they become:

$$Vlca = Vs - Vd; \text{ and}$$

$$Vlcb = Vs - Vd.$$

Further, at the time, the voltage Vcsa of the subsidiary capacity wire 24*a* and the voltage Vcsb of the subsidiary capacity wire 24*b* are:

$$Vcsa = Vcom - Vad; \text{ and}$$

$$Vcsb = Vcom + Vad.$$

In time T3, the voltage Vcsa of the subsidiary capacity wire 24*a* connected to the subsidiary capacity 22*a* changes from Vcom−Vad to Vcom+Vad, and the voltage Vcsb of the subsidiary capacity wire 24*b* connected to the subsidiary capacity 22*b* changes from Vcom+Vad to Vcom−Vad. Along with this change of voltages of the subsidiary capacity wires 24*a* and 24*b*, the voltages Vlca and Vlcb of each sub picture element electrode change as follows:

$$Vlca=Vs-Vd+2\times K\times Vad;\text{ and}$$

$$Vlcb=Vs-Vd-2\times K\times Vad.$$

Note that K=CCS/(CLC(V)+CCS). Here, CLC(V) is the value of capacitance of liquid crystal capacity in the sub picture elements 10*a* and 10*b*, and the value of CLC(V) depends on effective voltage (V) applied to liquid crystal layers of the sub picture elements 10*a* and 10*b*. Further, CCS is the value of capacitance of the subsidiary capacities 22*a* and 22*b*.

In time T4, Vcsa changes from Vcom+Vad to Vcom−Vad, and Vcsb changes from Vcom−Vad to Vcom+Vad, and Vlca and Vlcb also change from $$Vlca=Vs-Vd+2\times K\times Vad$$

$$Vlcb=Vs-Vd-2\times K\times Vad$$

to $$Vlca=Vs-Vd$$

$$Vlcb=Vs-Vd.$$

In time T5, Vcsa changes from Vcom−Vad to Vcom+Vad and Vcsb changes from Vcom+Vad to Vcom−Vad by twofold Vad, and Vlca and Vlcb also change from $$Vlca=Vs-Vd$$

$$Vlcb=Vs-Vd$$

to $$Vlca=Vs-Vd+2\times K\times Vad$$

$$Vlcb=Vs-Vd-2\times K\times Vad.$$

Vcsa, Vcsb, Vlca and Vlcb repeat alternately the change in the T3 and T5. The interval or phase of repetition of the T3 and T5 should be suitably set in consideration of a driving method of a liquid crystal display device (a method such as a polarity inversion method) and of a display state (such as flicker or rough surface of display) (for example, as for the interval of repetition of the T3 and T5, 0.5 H, 1H, 2 H, 4 H, 6 H, 8 H, 10 H, 12 H, . . . can be set (1 H is 1 horizontal scan period)). This repetition is continued until the next time the picture element 10 is rewritten, namely, until the time being equivalent to T1. Therefore, the effective values of the voltages Vlca and Vlcb of the sub picture element electrodes are:

$$Vlca=Vs-Vd+K\times Vad;\text{ and}$$

$$Vlcb=Vs-Vd-K\times Vad.$$

Therefore, effective voltages V1 and V2 applied to liquid crystal layers of the sub picture elements 10*a* and 10*b* are:

$$V1=Vlca-Vcom;\text{ and}$$

$$V2=Vlcb-Vcom.$$

Namely, $$V1=Vs-Vd+K\times Vad-Vcom;\text{ and}$$

$$V2=Vs-Vd-K\times Vad-Vcom.$$

Therefore, the difference of effective voltages applied to liquid crystal layers of the respective sub picture elements 10*a* and 10*b*, ΔV12 (=V1−V2), becomes ΔV12=2×K×Vad, and it is possible to apply to the sub picture elements 10*a* and 10*b* voltages different from each other.

However, according to the above conventional structure, there is a problem that uneven luminance appearing in a lateral streak occurs when a certain gradation (halftone) is displayed all over the display screen of a liquid crystal display device with large size and high definition. The cause of the occurrence of the uneven luminance appearing in a lateral streak is explained below with reference to FIGS. 8 and 9.

FIG. 8 is a plane view illustrating a relation of disposition between activation drivers and subsidiary capacity wires.

In a liquid crystal display device with large size and high definition, as illustrated in FIG. 8, it is general to use a plurality of gate drivers 30 and source drivers 32 for activating the scan line 12 (see FIG. 6) and the signal line 14 (see FIG. 6) in a display region. Note that in FIG. 8, the scan line 12 and the signal line 14 are not shown.

Further, all the subsidiary capacity wires 24*a* are connected to a subsidiary capacity main line 34*a*, and the voltage Vcsa is inputted to the subsidiary capacity main line 34*a* through several input points. In general, the input points of the voltage Vcsa are set between gate drivers 30 that are separately disposed. Note that FIG. 8 illustrates a structure for applying the subsidiary capacity voltage Vcsa to the subsidiary capacity wire 24*a*, and the subsidiary capacity voltage Vcsb is applied to the subsidiary capacity wire 24*b* with the same structure.

Here, according to the structure illustrated in FIG. 8, in the subsidiary capacity wire 24*a* (such as point B) being far from the input point of the voltage Vcsa (such as point S), compared to the subsidiary capacity wire 24*a* (such as point A) being near to the input point of the voltage Vcsa, the effect of electric charge due to electric resistance and parasitic capacitance included by the subsidiary capacity main line becomes large, so that voltage waveforms are blunted greatly, as illustrated in FIG. 9. Note that in FIG. 9, a full line shows a waveform of a voltage, supplied to the input point (point S), for driving the subsidiary capacity wire, a broken line shows the voltage waveform of the subsidiary capacity wire 24*a* (point A) near to the input point, and chain line shows the voltage waveform of the subsidiary capacity wire 24*a* (point B) far from the input point.

When the voltage waveforms of each subsidiary capacity wire 24*a* are different according to the distance from the input point, the potentials of each subsidiary capacity wire 24*a* vary depending upon timing when the gate of TFT is turned OFF. This becomes the cause of the occurrence of uneven luminance appearing in a lateral streak. The reason is explained below.

According to the above explanation by use of FIG. 7, voltages applied to liquid crystal layers in the multi-picture element driving are influenced by the voltages Vcsa or Vcsb of the subsidiary capacity wires, as well as by the voltage Vs of the signal line. The concrete performance of Vcsa or Vcsb is as follows.

In a general liquid crystal display device, liquid crystal capacity of each picture element is charged with a voltage from the signal line through its TFT element, after of which, it maintains the value of this signal voltage until next charging starts. On the contrary, in the liquid crystal display device of the multi-picture element driving, after charging is finished (after a TFT element is turned OFF), i.e. after time T2 of FIG. 7, the voltage oscillation of the CS bus line (Vcsa or Vcsb) oscillates the voltage of the liquid crystal capacity through the subsidiary capacity. Thus, the voltage of the liquid crystal capacity is influenced by the voltage oscillation of the CS bus line. What matters here is that, voltage oscillation of the liquid crystal capacity accompanying voltage oscillation of the CS bus line refers to the voltage of the CS bus line at the time when TFT element is turned OFF, i.e. at the time T2 of FIG. 7. That is, the voltage of the CS bus line increasing and decreasing (oscillating) from this reference voltage is superposed on the voltage of liquid crystal capacity at the time T2 (in a narrow sense, a voltage obtained by subtracting Vd from a charge voltage of the signal line). In other words, the influence of the voltage oscillation of the CS bus line on the voltage of liquid crystal capacity in the multi-picture element driving depends on the voltage of the CS bus line at the time when the TFT element is turned OFF, i.e. at the time T2 of FIG. 7. Therefore, in timing when the gate of a TFT is turned OFF, when the potentials of the subsidiary capacity wires 24*a* differ from each other, how much the oscillation voltage of the CS bus line influences on the voltage of liquid crystal capacity differs, with a result that voltages applied to liquid crystal layers differ, and accordingly uneven luminance appearing in a lateral streak occurs.

SUMMARY OF THE INVENTION

An object of the present invention is to provide a liquid crystal display device performing multiple picture element driving, which can prevent the occurrence of uneven luminance appearing in a lateral streak.

In order to achieve the above object, the liquid crystal display device according to the present invention is a liquid crystal display device in which one display picture element includes a plurality of sub picture elements capable of providing mutually different luminance levels, difference of the luminance levels between the sub picture elements, which are connected to respective subsidiary capacity wires allowing voltage signals to be applied thereto, results from application of different voltages of the voltage signals to the subsidiary capacity wires, and OFF timing of a switching element connected between the sub picture element and a signal line is matched with phase timing when all the subsidiary capacity wires to which the same voltage signal is applied (points A and B in FIG. 8) are at the same potential.

In the above liquid crystal display device in which one display picture element includes a plurality of sub picture elements capable of providing mutually different luminance levels (multi-picture element driving), difference of the luminance levels between the sub picture elements, which are connected to respective subsidiary capacity wires allowing voltage signals to be applied thereto, results from application of different voltages of the voltage signals to the subsidiary capacity wires. However, voltage waveforms of the above subsidiary capacity wires are blunted differently in terms of a signal, depending upon the distance from the input point of the applied voltage signal (in general, there are several points). As a result, variation in potentials of the subsidiary capacity wires at a time point when a switching element connected between each sub picture element and a signal line is turned OFF (namely, at a time point when each picture element is shut off from the signal line and the amount of charge for a picture element is determined), causes variation in the amount of charge for each picture element. This resulted in uneven luminance appearing in a lateral streak.

On the other hand, with the above arrangement, the OFF timing of a switching element connected between each sub picture element and a signal line is matched with the phase timing when all the subsidiary capacity wires to which the same voltage signal is applied are at the same potential, so that variations in the amount charged to picture elements connected to each scan line can be eliminated, and accordingly the occurrence of the uneven luminance can be prevented.

For a fuller understanding of the nature and advantages of the invention, reference should be made to the ensuing detailed description taken in conjunction with the accompanying drawings.

DESCRIPTION OF THE EMBODIMENTS

[First Embodiment]

Figure 6:
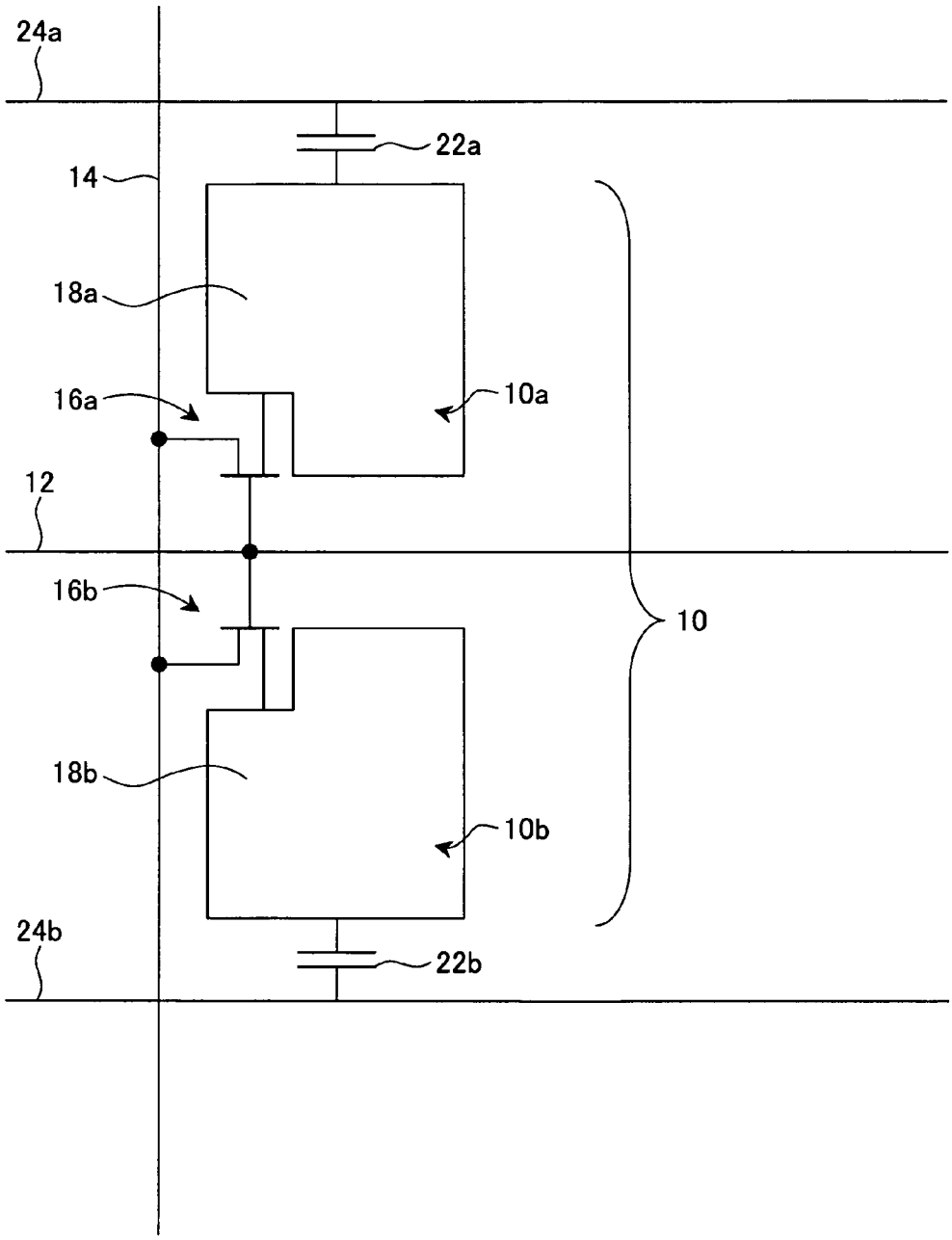
FIG. 6 is a view illustrating a structure of a picture element of a liquid crystal display device for multi-picture element driving.
Figure 8:
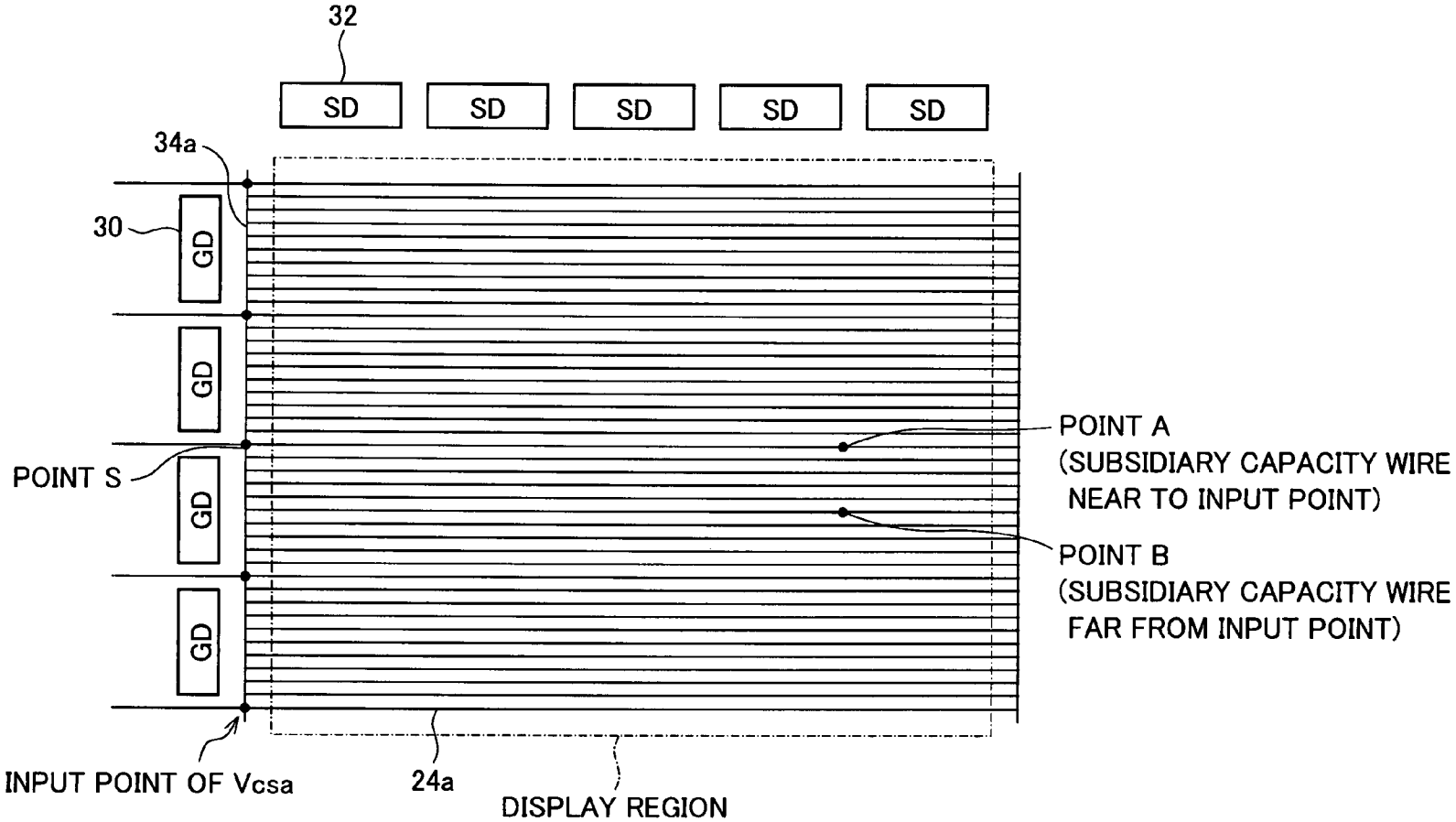
FIG. 8 is a plane view illustrating a structure of wiring of the subsidiary capacity wires in the liquid crystal display device for multi-picture element driving.

One embodiment of the present invention is explained below with reference to figures. Note that a liquid crystal display device according to the present embodiment, which performs multi-picture element driving, is characterized by its driving signals, and a structure of the device may be the same as a structure of a conventional liquid crystal display device (namely, a structure illustrated in FIGS. 6 and 8). Therefore, the present embodiment makes the structure of the liquid crystal display device the same as that illustrated in FIGS. 6 and 8, and explanation is given using reference numerals of these figures.

Figure 7:
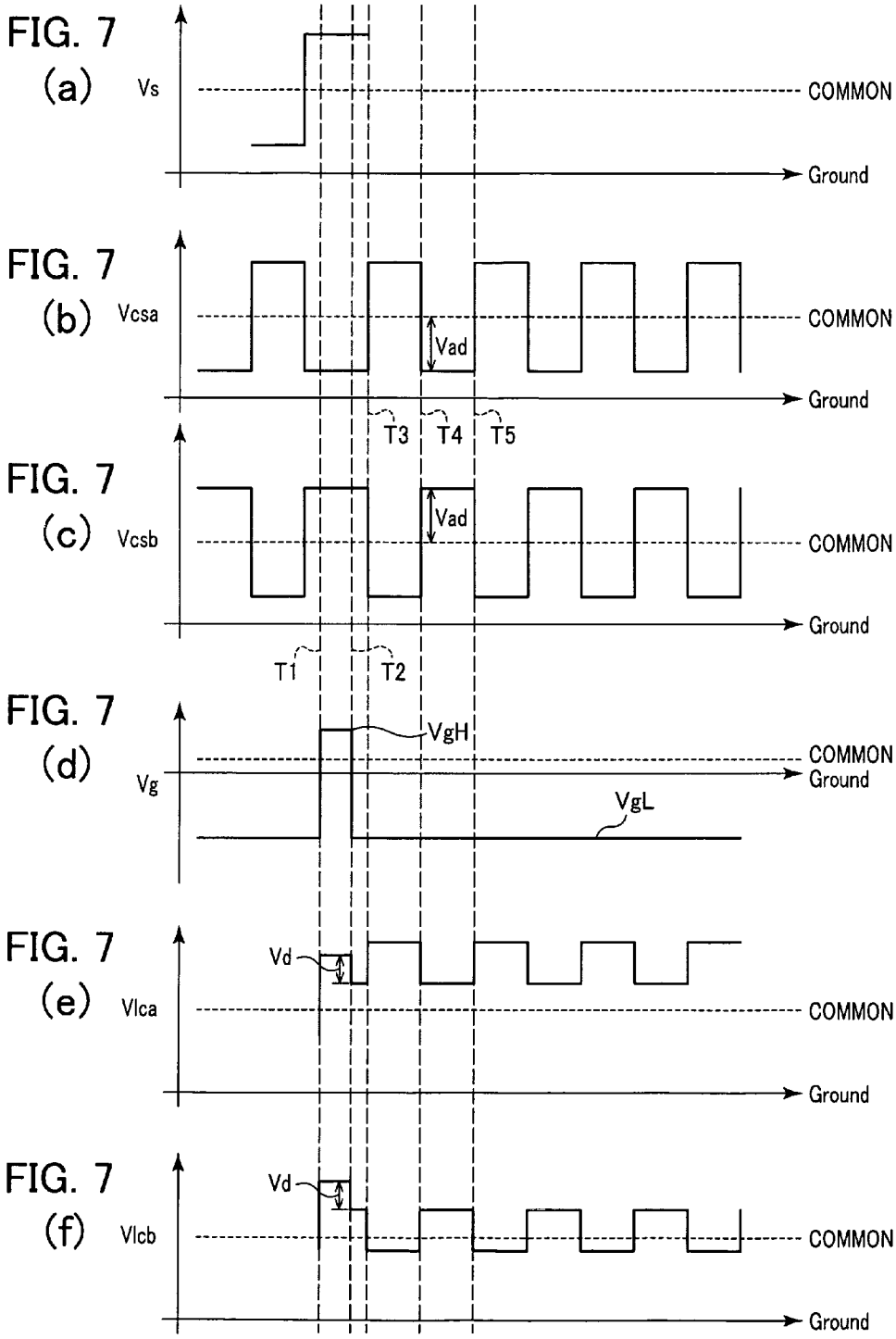
FIGS. 7(*a*) through 7(*f*) are waveform charts illustrating conventional driving signals in the liquid crystal display device for multi-picture element driving.

First, the driving signals of the liquid crystal display device according to the present embodiment is different from the driving signal in FIG. 7 in that they control the phases of input signals to the subsidiary capacity wires 24*a* and 24*b* (voltage waveforms Vcsa and Vcsb) in accordance with OFF timing of a scanning signal of the scan line 12 (voltage waveform Vg). Namely, the relation between voltage waveform Vs of the signal line 14 shown in FIG. 7(*a*) and voltage waveform Vg of the scan line 12 shown in FIG. 7(*d*) is the same as that of the conventional example.

Figure 1:
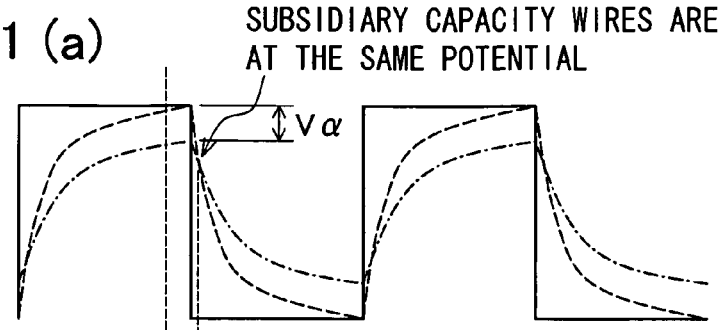
FIG. 1(*a*) illustrates a voltage signal applied to a subsidiary capacity wire and its voltage waveforms, FIG. 1(*b*) illustrates a scanning signal for comparison, FIG. 1(*c*) illustrates effective voltages of picture element electrodes after oscillation voltages of the subsidiary capacity wires are superposed when the scanning signal of FIG. 1(*b*) is used, FIG. 1(*d*) illustrates a scanning signal of the present invention, and FIG. 1(*e*) illustrates effective voltages of picture element electrodes after oscillation voltages of the subsidiary capacity wires are superposed when the scanning signal of the FIG. 1(*d*) is used.
Figure 1:
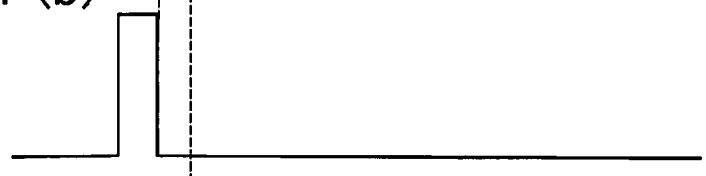
Figure 1:
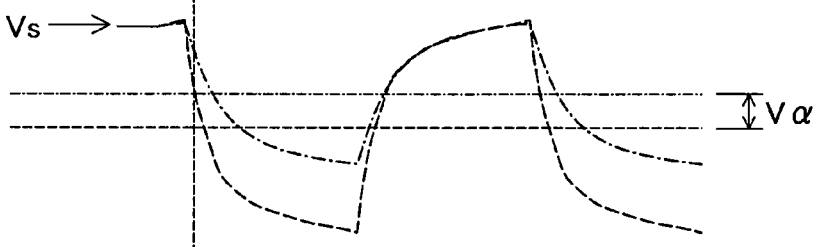
Figure 1:
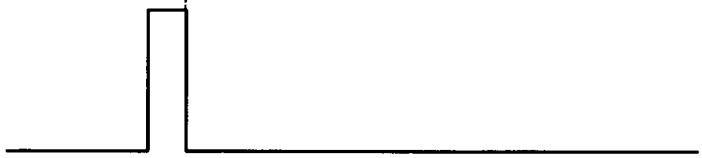
Figure 1:
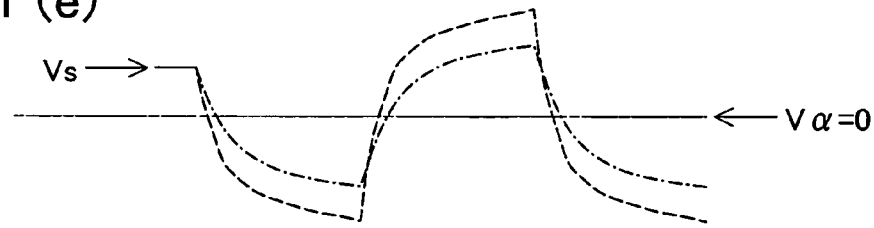

As for the liquid crystal display device according to the present embodiment, a method for preventing the occurrence of uneven luminance appearing in a lateral streak is explained below with reference to FIGS. 1(*a*) through 1(*e*). FIG. 1(*a*) illustrates a waveform of a voltage, supplied to an input point (FIG. 8, point S), for driving a subsidiary capacity wire (shown by a full line in FIG. 1(*a*)), a voltage waveform of the subsidiary capacity wire 24*a* near to the input point (FIG. 8, point A) (shown by a broken line in FIG. 1(*a*)) and a voltage waveform of the subsidiary capacity wire 24*a* far from the input point (FIG. 8, point B) (shown by a chain line in FIG. 1(*a*)). FIG. 1(*b*) illustrates a scanning signal shown for comparison, and corresponds to Vg in FIG. 7(*d*). FIG. 1(*c*) illustrates voltage waveforms after an oscillation voltage of the subsidiary capacity wire shown by the broken line or the chain line of FIG. 1(*a*) is superposed on picture element electrodes of a liquid crystal layer when TFT element is turned OFF by the scanning signal of FIG. 1(*b*), and corresponds to FIG. 7(*f*). FIG. 1(*d*) is a scanning signal of the liquid crystal display device according to the present embodiment. FIG. 1(*e*) illustrates voltage waveforms after an oscillation voltage of the subsidiary capacity wire shown by the broken line or the chain line of FIG. 7(*a*) is superposed on picture element electrodes of a liquid crystal layer when a TFT element is turned OFF by the scanning signal of FIG. 1(*d*), and corresponds to FIG. 7(*f*).

Note that for convenience, two kinds of scanning signal waveforms are shown relative to one subsidiary capacity voltage waveform in FIG. 1, but in an actual liquid crystal display device, a scanning signal waveform is determined according to signal line voltage waveform Vs, with a result that the scanning signal waveform cannot be changed. Therefore, in optimization of a phase of a voltage waveform of a subsidiary capacity wire in accordance with OFF timing of the above scanning signal, the optimization is carried out by changing the phase of the voltage of the subsidiary capacity wire.

First, a case where the scanning signal shown in FIG. 1(*b*) carries out driving control is discussed. In the case of using the scanning signal shown in FIG. 1(*b*), when a scanning signal of a certain scan line 12 is turned OFF, all picture elements connected to this scan line 12 are shut off from the signal line 14 and the amount of charge is determined. Further, in OFF timing of this scanning signal, the potential of the subsidiary capacity wire 24*a* near to the input point is different from that of the subsidiary capacity wire 24*a* far from the input point by Vα. At the time, FIG. 1(*c*) tells that as for effective voltages of picture element electrodes after oscillation voltages of the subsidiary capacity wires are superposed thereto, the broken line (the voltage of a picture element electrode connected to the subsidiary capacity wire 24*a* near to the input point) and the chain line (the voltage of a picture element electrode connected to the subsidiary capacity wire 24*a* far from the input point) are different from each other in their effective voltages (the voltages shown respectively by the straight broken line and the straight chain line) by Vα. Therefore, the potential difference Vα of the subsidiary capacity wires is reflected as the difference of voltages applied to liquid crystal capacities of sub picture elements connected to each scan line, i.e. the difference of luminance between the sub picture elements, and this causes uneven luminance appearing in a lateral streak.

On the other hand, as shown in FIG. 1(*a*), in the voltage waveform (broken line) of the subsidiary capacity wire 24*a* near to the input point and the voltage waveform (chain line) of the subsidiary capacity wire 24*a* far from the input point, there is a cross point in each inversion cycle, namely, there is timing when the above Vα becomes zero. And as shown in FIG. 1(*d*), in the liquid crystal display device according to the present embodiment, the cross point of these voltage waveforms, namely, phase timing when potentials of the subsidiary capacity wires become equal to each other, are matched with OFF timings of the scanning signals. At the time, according to FIG. 1(*e*), the effective voltages of picture element electrodes after oscillation voltages of the subsidiary capacity wires are superposed thereto, are shown by a broken line (a voltage of a picture element electrode connected to the subsidiary capacity wire 24*a* near to the input point) and a chain line (a voltage of a picture element electrode connected to the subsidiary capacity wire 24*a* far from the input point), and their effective voltages (voltages shown respectively by the broken line and the chain line (both lines coincide)) conform to each other. Therefore, the above uneven luminance appearing in a lateral streak is never generated.

In this way, as shown by a relation shown in FIGS. 1(*a*) and 1(*c*), the liquid crystal display device according to the present invention can eliminate the difference in voltages applied to liquid crystal capacities of sub picture elements connected to each scan line by matching OFF timing of a scanning signal with phase timing when potentials of the subsidiary capacity wires become equal to each other, so as to prevent the generation of uneven luminance appearing in a lateral streak.

[Second Embodiment]

A modified example of the present invention is explained in second embodiment. The above first embodiment uses binary oscillation voltages in a signal for driving subsidiary capacity wires and controls a phase of the oscillation, but there are below problems in applying this structure to an actual liquid crystal display device.

Namely, as is evident from FIG. 1(*a*), approximately at the cross point of the voltage waveform (the broken line) of the subsidiary capacity wire 24*a* near to the input point and the voltage waveform (the chain line) of the subsidiary capacity wire 24*a* far from the input point, inclinations of voltage waveforms are steep. In this case, when gate OFF timing of a TFT by a falling edge of a scanning signal shifts from the above crossing point even a little, there occurs the potential difference between the subsidiary capacity wires. This results in the occurrence of uneven luminance appearing in a lateral streak. Namely, a timing margin for controlling phase timing when potentials of the subsidiary capacity wires become equal to each other is very narrow. To be specific, the result of testing by use of a liquid crystal display device with large size and high definition by the inventor and others shows that the timing margin of timing for eliminating the above uneven luminance is on the order of 0.12 μs.

In this way, when the timing margin of phase timing when potentials of subsidiary capacity wires become equal is very narrow, consideration of characteristics variations of liquid crystal display devices tells that an adjustment step for putting gate OFF timing within the above timing margin is indispensable, and it brings a problem such as the decrease in productivity. Further, even after putting the phase timing when the subsidiary capacity wires are the same potential within the above timing margin, the occurrence of uneven luminance might not be prevented because of variation of the above timing due to the environment of the device (such as temperature).

Figure 2:
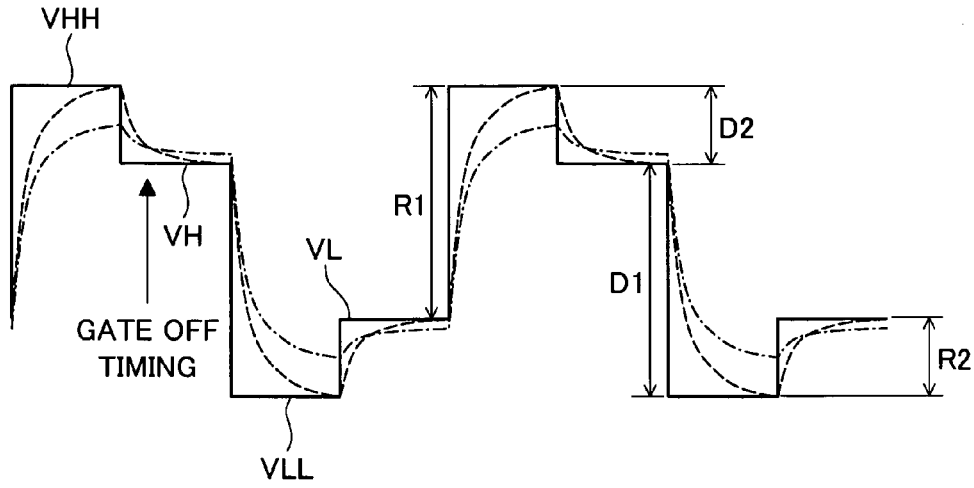
FIG. 2 is a waveform chart showing the voltage signal applied to a subsidiary capacity wire, the voltage signal being a quaternary signal, and how much the voltage waveforms of the subsidiary capacity wires are blunted with respect to the voltage signal.

On the other hand, the liquid crystal display device according to the second embodiment solves the above problem by broadening the timing margin of gate OFF timing to eliminate uneven luminance. For this purpose, as shown in FIG. 2, the liquid crystal display device according to the second embodiment uses quaternary oscillation voltages in a signal for driving subsidiary capacity wires. Namely, the signal for driving subsidiary capacity wires in the second embodiment changes in the order of the following four values: VHH, VH, VLL and VL (VHH>VH>VL>VLL). Note that in FIG. 2 as well as FIG. 1, a waveform of a voltage, supplied to an input point (FIG. 8, point S), for driving a subsidiary capacity wire is shown by a full line, a voltage waveform of a subsidiary capacity wire 24*a* near to the input point (FIG. 8, point A) is shown by a broken line, and a voltage waveform of the subsidiary capacity wire 24*a* far from the input point (FIG. 8, point B) is shown by a chain line.

When a signal for driving the subsidiary capacity wire is made the quaternary signal as shown in FIG. 2, a cross point of the voltage waveform of the subsidiary capacity wire 24*a* near to the input point (FIG. 8, point A) and the voltage waveform of the subsidiary capacity wire 24*a* far from the input point (FIG. 8, point B) can be set between voltage VHH and VH, and between VLL and VL.

The reason is that the voltage waveform of the subsidiary capacity wire 24*a* near to the input point changes more sharply than the voltage waveform of the subsidiary capacity wire 24*a* far from the input point, and both the amount of a leading edge and that of a falling edge of voltages per unit time are large. Therefore, at a time point when a change in voltage from VL to VHH (a change in voltage toward the leading edge) is finished, the voltage waveform of the subsidiary capacity wire 24*a* near to the input point (shown by the broken line in FIG. 2) reaches a higher position than that of the subsidiary capacity wire 24*a* far from the input point (shown by the chain line in FIG. 2). Thereafter, at a time point when a change in voltage from VHH to VH (a change in voltage toward the falling edge) is finished, the voltage waveform of the subsidiary capacity wire 24*a* near to the input point (shown by the broken line in FIG. 2) reaches a lower position than that of the subsidiary capacity wire 24*a* far from the input point. Namely, in the course of the change in voltage from VHH to VH (the change in voltage toward the falling edge), the voltage waveform of the subsidiary capacity wire 24*a* far from the input point (shown by the chain line in FIG. 2) and that of the subsidiary capacity wire 24*a* near to the input point (shown by the broken line in FIG. 2) cross each other. And approximately at this cross point, the inclinations of the voltage waveforms become milder than when a binary signal as shown in FIG. 1 is used, and the timing margin for controlling gate OFF timing is broadened.

Figure 9:
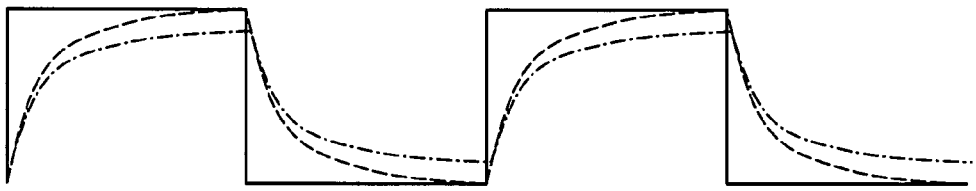
FIG. 9 is a waveform chart illustrating how much voltage waveforms in the subsidiary capacity wire are blunted.
Figure 10:
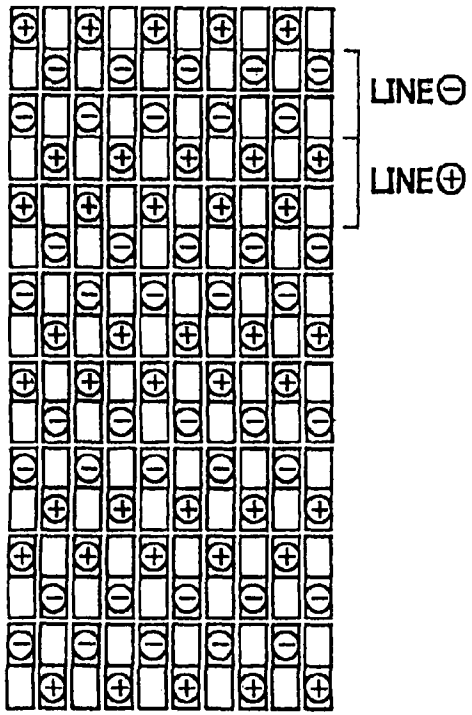
FIGS. 10(*a*) and 10(*b*) are examples of arrangement of sub picture elements placed over a plurality of picture elements, and FIG. 10(*c*) is a plane view illustrating an example of a shape of a sub picture element.
Figure 10:
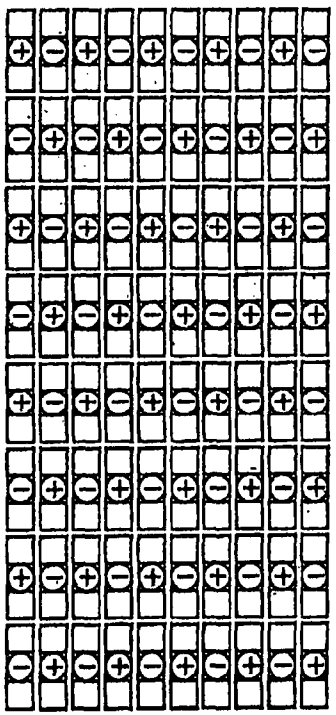
Figure 10:
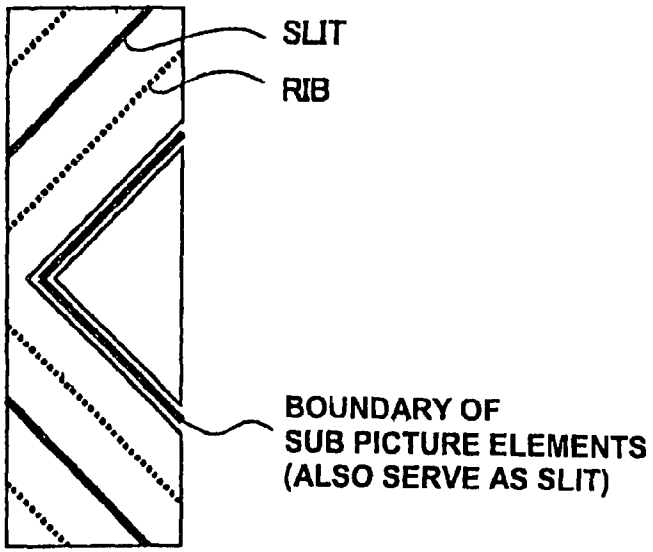

The reason is that when the influence of an oscillation voltage waveform of the subsidiary capacity wire on voltages applied to a liquid crystal layer in multi-picture element driving is constant, a change in voltage from VHH to VH in a case of using a quaternary waveform shown in FIG. 2 (a variation in voltage of a voltage changing region in which a cross point of the voltage waveform shown by the broken line and the voltage waveform shown by the chain line is generated) is smaller than a variation in voltage (amplitude) of a binary signal waveform shown in FIG. 9. Therefore, in respect of the above inclination of voltages at a time point near a crossing point of voltage waveforms, the one using the quaternary signal waveform of FIG. 2 is milder than the one using the binary signal waveform of FIG. 9.

As a result of analysis of the same liquid crystal display device with large size and high definition as the above first embodiment, with the same evaluation criteria as the first embodiment, by the inventor of the present application, it was verified that the timing margin for eliminating uneven luminance becomes on the order of 1.2 μs that is about ten times as wide as 0.12 μs in the case of using the binary signal in the first embodiment.

In this way, the liquid crystal display device according to the second embodiment can omit the adjustment step for putting the phase timing when the subsidiary capacity wires are at the same potential within the timing margin by broadening the timing margin, with a result that the problem of decrease in productivity can be avoided. Therefore, even when characteristics such as charge characteristics change due to the environment of device (such as temperature), the effect of preventing uneven luminance can be maintained.

Figure 3:
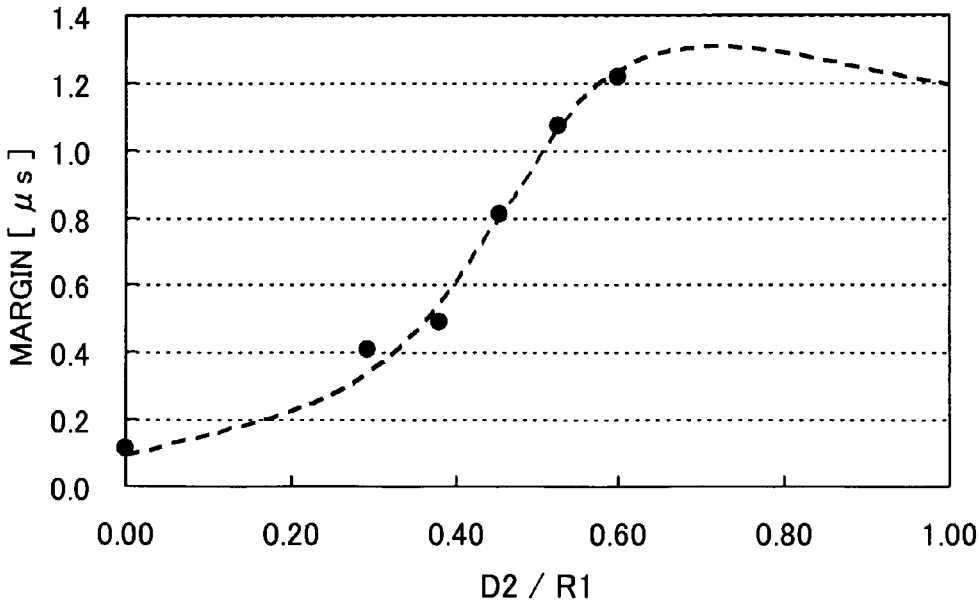
FIG. 3 is a graph illustrating a relation between index R2/R1 and a timing margin for preventing uneven luminance.

A preferred example of the waveform of a voltage for driving a subsidiary capacity wiring is explained below in detail. As shown in FIG. 3, in the second embodiment, a variation in voltage in a leading edge from a voltage VL to a voltage VHH in the driving signal of the subsidiary capacity wire is R1, a variation in voltage in a falling edge from a voltage VH to a voltage VLL is D1, a variation in voltage in a falling edge from a voltage VHH to a voltage VH is D2 (<D1), and a variation in voltage in a leading edge from a voltage VLL to a voltage VL is R2 (<R1). Note that the variations R1, R2, D1 and D2 show absolute values of the differences in voltage between a point before a voltage change and a point after a voltage change.

Here, as an index for quantitatively evaluating the effect of the present invention, D2/R1 is used. Note that the present embodiment assumes that variations in voltages of R1 and D1 are equal to each other, and variations in voltages of R2 and D2 are equal to each other. Further, in the case of a conventional binary voltage waveform, considering each of R2 and D2 as 0, it is set so that D2/R1 (=R2/D1)=0. Further, even when D2/R1, which is the above index, is determined, the values of R1, R2, D1 and D2 are not determined as unique values. Therefore, an adjustment is performed so that luminance of 64/255 becomes equal in a case of using a binary voltage waveform with oscillation of 4Vpp, namely, a variation in voltages of a picture element caused by superposition of oscillation waveforms of subsidiary capacity wires becomes constant. Of course, evaluation of the uneven luminance appearing in a streak was performed in 64/255 gradation. Further, periods for applying each voltage of VHH, VH, VL and VLL in a quaternary voltage waveform were set as equal one.

FIG. 3 is a graph showing a relation between the index D2/R1 and the timing margin for preventing uneven luminance. This graph shows the result of testing that is obtained experimentally by use of plural kinds of signals with different indices D2/R1, and whether uneven luminance was prevented or not was judged according to visual observation of a display screen.

FIG. 3 shows that increase of the index D2/R1 broadens the timing margin for preventing the uneven luminance. Namely, it was suggested that for the purpose of making the timing margin as large as possible, it is effective to set suitably the value of the index D2/R1. To put it concretely, the effect starts when the value of D2/R1 is equal to or more than 0, the effect is evident when the value is equal to or more than 0.2, and the effect is large when the value is equal to or more than 0.5. The test by the inventor and others was carried out so that D2/R1 changed in a range from 0 to 0.6 (• in FIG. 3 indicates a tested point). In this range, the maximum effect was obtained when D2/R1=0.6. Note that the reason why the value of D2/R1 was set in a range from 0 to 0.6 is because of a range of output voltages of driving circuits, and not because of essential limits relating to the present invention.

Note that in FIG. 3, in the experimented range of the index D2/R1 (shown by • in FIG. 3), increase of the index D2/R1 broadens the timing margin, but it is expected that when the index D2/R1 is further large, the timing margin becomes small. The reason is that the larger the value of D2/R1 becomes, the larger the variation in voltages by D2 (or R2) becomes, and accordingly it is expected that the waveform inclination near the cross point of the broken line and the chain line shown in FIG. 2 becomes steep again.

Figure 4:
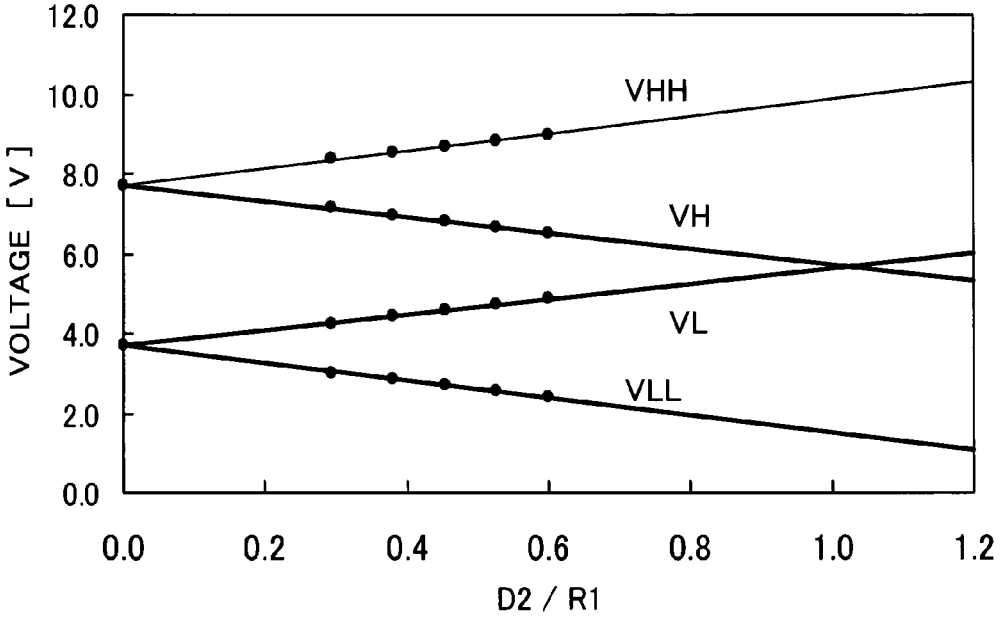
FIG. 4 is a graph illustrating a relation between index R2/R1 and VHH, VH, VL and VLL as the variation of a picture element voltage caused by superposing of oscillation waveforms of the subsidiary capacity wire is adjusted so as to be a certain amount in the experiment in FIG. 3.
Figure 5:
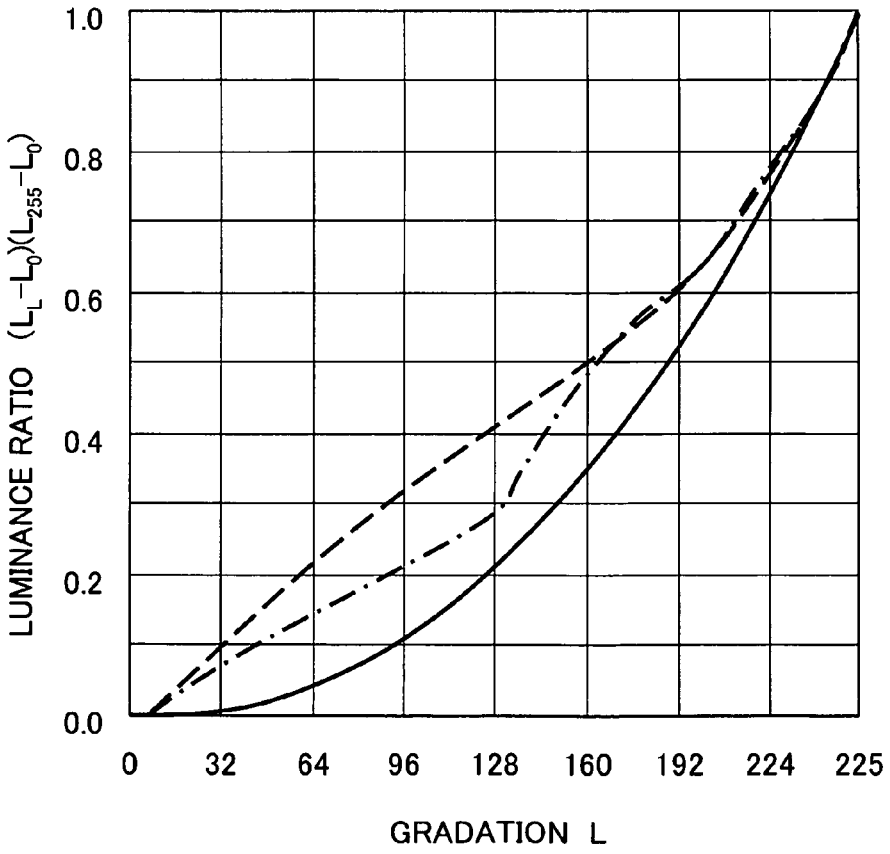
FIG. 5 is a graph illustrating gradation-luminance characteristics both in general driving and multi-picture element driving.

FIG. 4 shows the values of VHH, VH, VL and VLL when the adjustment was performed in the experiment of FIG. 3 so that the variations of picture element voltages caused by superposition of oscillation waveforms of subsidiary capacity wires become constant. According to FIG. 4, the relation of VHH>VH>VL>VLL that is the condition for obtaining the effect of the present invention is established when the value of D2/R1 is approximately in a range from 0 to 1.

According to the result of FIGS. 3 and 4, the effect of the present invention starts when the value of D2/R1 is in a range from 0 to 1, the effect is evident when the value of D2/R1 is in a range from 0.2 to 1, and the effect is large when the value of D2/R1 is in a range from 0.5 to 1.

Note that in the present embodiment, periods for applying each voltage of VHH, VH, VL and VLL in the quaternary voltage waveform are all identical, but the effect of the present invention is not limited to this. However, it is a preferable condition that the periods for applying each voltage of VHH, VH, VL and VLL are all identical, namely, a period for the voltage waveform of the subsidiary capacity wire 24*a* to respond to the change of the voltage of R1 (or D1) is equal to a period for the voltage waveform of the subsidiary capacity wire 24*a* to respond to the change of voltage of D2 (or R2). The reason is explained below with reference to FIG. 4. When the period for responding to the change of the voltage of R1 (or D1) becomes shorter than the period for responding to the change of the voltage of D2 (or R2), voltages on the subsidiary capacity wires do not reach the value that is equal to or more than VH (or equal to or less than VL) due to the change of the voltage of R1 (or D1), and in this case the phenomenon that is the operation of the present invention, namely, the phenomenon that in responding to the change of the voltage of D2 (or R2), the voltage waveform of the subsidiary capacity wire 24*a* near to the input point (shown by the broken line in FIG. 2) crosses the voltage waveform of the subsidiary capacity wire 24*a* far from the input point (shown by the chain line in FIG. 2), is not generated. On the other hand, when the period for responding to the change of the voltage of D2 (or R2) is shorter than the period for responding to the change of the voltage of R1 (or D1), the period for the voltage on the subsidiary capacity wire to respond to the change of the voltage of D2 (or R2) becomes short, with a result that the phenomenon that is the operation of the present invention, namely, the phenomenon that in responding to the change of the voltage of D2 (or R2), the voltage waveform of the subsidiary capacity wire 24*a* near to the input point (shown by the broken line in FIG. 2) crosses the voltage waveform of the subsidiary capacity wire 24*a* far from the input point (shown by the chain line in FIG. 2), is not generated. Therefore, in the present invention, it is preferable that the periods for applying each voltage of VHH, VH, VL and VLL are all identical, namely, the period for the voltage waveform of the subsidiary capacity wire 24*a* to respond to the change of the voltage of R1 (or D1) is equal to the period for the voltage waveform of the subsidiary capacity wire 24*a* to respond to the change of the voltage of D2 (or R2).

Note that in the liquid crystal display device according to the present invention, the number of sub picture elements is not limited to two, and it may be more than two. Further, a shape of a sub picture element or an area ratio of the sub picture elements is not particularly limited. For example, according to image quality of a display screen, there is a case where the shape of a sub picture element may be preferably not a rectangle, and according to the effect of improvement in viewing angle, an arrangement in which the area of a sub picture element with high display luminance is the smaller, is preferable to an arrangement in which the areas of the sub picture elements are equal to each other.

As shown above, the liquid crystal display device according to the present invention is a liquid crystal display device in which one display picture element includes a plurality of sub picture elements capable of providing mutually different luminance levels, difference of the luminance levels between the sub picture elements, which are connected to respective subsidiary capacity wires allowing voltage signals to be applied thereto, results from application of different voltages of the voltage signals to the subsidiary capacity wires, and OFF timing of a switching element connected between the sub picture element and a signal line is matched with phase timing when all the subsidiary capacity wires to which the same voltage signal is applied (points A and B in FIG. 8) are at the same potential.

In the above liquid crystal display device in which one display picture element includes a plurality of sub picture elements capable of providing mutually different luminance levels, difference of the luminance levels between the sub picture elements, which are connected to respective subsidiary capacity wires allowing voltage signals to be applied thereto, results from application of different voltages of the voltage signals to the subsidiary capacity wires. However, voltage waveforms of the above subsidiary capacity wires are blunted differently in terms of a signal, depending upon the distance from the input point of the applied voltage signal (in general, there are several points). As a result, variation in potentials of the subsidiary capacity wires at a time point when a switching element connected between each sub picture element and a signal line is turned OFF (namely, at a time point when each picture element is shut off from the signal line and the amount of charge for a picture element is determined), causes variation in the amount of charge for each picture element. This resulted in uneven luminance appearing in a lateral streak.

On the other hand, with the above arrangement, the OFF timing of a switching element connected between each sub picture element and a signal line is matched with the phase timing when all the subsidiary capacity wires to which the same voltage signal is applied are at the same potential, so that variations in the amount charged to picture elements connected to each scan line can be eliminated, and accordingly the occurrence of the uneven luminance can be prevented.

Further, it is preferable that in the liquid crystal display device, the voltage signal applied to the subsidiary capacity wire is a quaternary signal having four voltage values VHH, VH, VLL and VL periodically changing in this order, the four voltage values satisfying a relation of VHH>VH>VL>VLL.

With the arrangement, in the vicinity of phase timing when all the subsidiary capacity wires are at the same potential, namely, in the vicinity of a cross point of a slightly blunted voltage waveform of a subsidiary capacity wire and a greatly blunted voltage waveform of a subsidiary capacity wire, a change of voltages can be mild. As a result, the timing margin of OFF timing of a switching element connected between each sub picture element and the signal line can be broadened. This facilitates timing control of the OFF timing.

Concrete embodiments explained in the "DESCRIPTION OF THE EMBODIMENTS" are first and foremost to clarify the technical contents of the present invention, and the present invention is not to be limited to such concrete embodiments, and a variety of modifications are possible within the spirit and scope of the invention, and within the scope of the following claims.

What is claimed is:

1. A liquid crystal display comprising:

a plurality of display pixels, each of the plurality of display pixels including, a plurality of sub pixels configured to provide at least two mutually different luminance levels, the at least two mutually different luminance levels including a relatively high luminance and a relatively low luminance, a first sub pixel of the plurality of sub pixels configured to produce the relatively high luminance and located in a same position for each of the plurality of display pixels, wherein each of the plurality of sub pixels is configured to produce a multi-tone display having at least three luminance levels corresponding to an applied voltage.

2. The liquid crystal display of claim 1, wherein a center of high luminance for at least one of the plurality of display pixels corresponds to a center of the at least one display pixel.

3. The liquid crystal display of claim 1, wherein the at least one display pixel includes, a first sub pixel of the plurality of sub pixels separated from a second sub pixel of the plurality of sub pixels by a slit, the first sub pixel being a sub pixel configured to produce the relatively high luminance.

4. The liquid crystal display of claim 3, wherein the first sub pixel is in a center of the at least one display pixel.

5. The liquid crystal display of claim 3, wherein the first sub pixel is rectangular.

6. The liquid crystal display of claim 3, wherein the first sub pixel is a rhomboid.

7. The liquid crystal display of claim 3, wherein the first sub pixel is triangular.

8. The liquid crystal display of claim 1, wherein a weighted center of high luminance for at least one of the plurality of display pixels corresponds to a luminance of the sub pixel configured to produce the relatively high luminance for the at least one display pixel.

9. The liquid crystal display of claim 1, wherein each of the plurality of display pixels includes a weighted center of high luminance, the weighted center being the same for each of the plurality of display pixels.

10. The liquid crystal display of claim 1, wherein sub pixels having a same polarity are arranged in a checkered pattern.

11. The liquid crystal display of claim 10, wherein the at least one display pixel includes, a first sub pixel of the plurality of sub pixels separated from a second sub pixel of the plurality of sub pixels by a slit, the first sub pixel being a sub pixel configured to produce the relatively high luminance.

12. The liquid crystal display of claim 2, wherein the at least one display pixel includes, a first sub pixel of the plurality of sub pixels separated from a second sub pixel of the plurality of sub pixels by a slit, the first sub pixel being a sub pixel configured to produce the relatively high luminance.

13. A liquid crystal display comprising:

at least one display pixel including a plurality of sub pixels configured to provide at least two mutually different luminance levels, the at least two mutually different luminance levels including a relatively high luminance and a relatively low luminance and a majority of sub pixels configured to produce the relatively high luminance are arranged linearly, wherein each of the plurality of sub pixels is configured to produce a multi-tone display having at least three luminance levels corresponding to an applied voltage.

14. The liquid crystal display of claim 13, wherein a center of high luminance for the at least one display pixel corresponds to a center of the at least one display pixel.

15. The liquid crystal display of claim 13, wherein the at least one display pixel includes, a first sub pixel of the plurality of sub pixels separated from a second sub pixel of the plurality of sub pixels by a slit, the first sub pixel being a sub pixel configured to produce the relatively high luminance.

16. The liquid crystal display of claim 15, wherein the first sub pixel is in a center of the at least one display pixel.

17. The liquid crystal display of claim 15, wherein the first sub pixel is rectangular.

18. The liquid crystal display of claim 15, wherein the first sub pixel is a rhomboid.

19. The liquid crystal display of claim 15, wherein the first sub pixel is triangular.

20. The liquid crystal display of claim 13, wherein a weighted center of high luminance for the at least one display pixel corresponds to a luminance of a sub pixel configured to produce the relatively high luminance.

21. The liquid crystal display of claim 13, wherein each of the at least one display pixel includes a weighted center of high luminance, the weighted center being the same for each of the at least one display pixel.

22. The liquid crystal display of claim 13, wherein sub pixels having a same polarity are arranged in a checkered pattern.

* * * * *